United States Patent [19]

Dooley et al.

[11] Patent Number: 5,005,245

[45] Date of Patent: Apr. 9, 1991

[54] PIPE COATING REMOVAL SYSTEM

[75] Inventors: R. Dennis Dooley, Carrollton; Daryl W. Morris, Tina; Dana L. Scott; Jimmy A. Watts, both of Carrollton, all of Mo.

[73] Assignee: Atlantic Richfield Company, Los Angeles, Calif.

[21] Appl. No.: 420,446

[22] Filed: Oct. 12, 1989

[51] Int. Cl.[5] ..... B08B 9/02

[52] U.S. Cl. ..... 15/104.04; 15/88; 118/DIG. 11

[58] Field of Search ..... 15/104.04, 88; 118/DIG. 11; 29/81 G

[56] References Cited

U.S. PATENT DOCUMENTS

| | | | |
|---|---|---|---|
| 1,680,372 | 8/1928 | Fenn | 15/104.04 |
| 2,782,436 | 2/1957 | Tomer | 15/104.04 |
| 2,813,285 | 11/1957 | Aslin et al. | 15/104.04 |
| 3,066,254 | 11/1962 | Price et al. | 15/104.04 X |

*Primary Examiner*—Edward L. Roberts

*Attorney, Agent, or Firm*—Michael E. Martin

[57] ABSTRACT

Coatings are removed from sections of pipeline by a tool having opposed semicylindrical body members hinged together and provided with a quick release over-center-type clamping mechanism for clamping the body members together when the tool has been assembled over a section of pipeline. A plurality of scraper blades are pivotally supported circumferentially spaced about the tool on respective ones of the body members for engagement with the pipe to remove coating material therefrom as the tool is towed along the pipe. Toxic coating materials are removed during a process wherein a catcher frame is supported by the pipe and having a material-collecting hammock slung under the pipe for collecting toxic coating materials as the tool is towed along the pipe.

9 Claims, 4 Drawing Sheets

FIG. 2
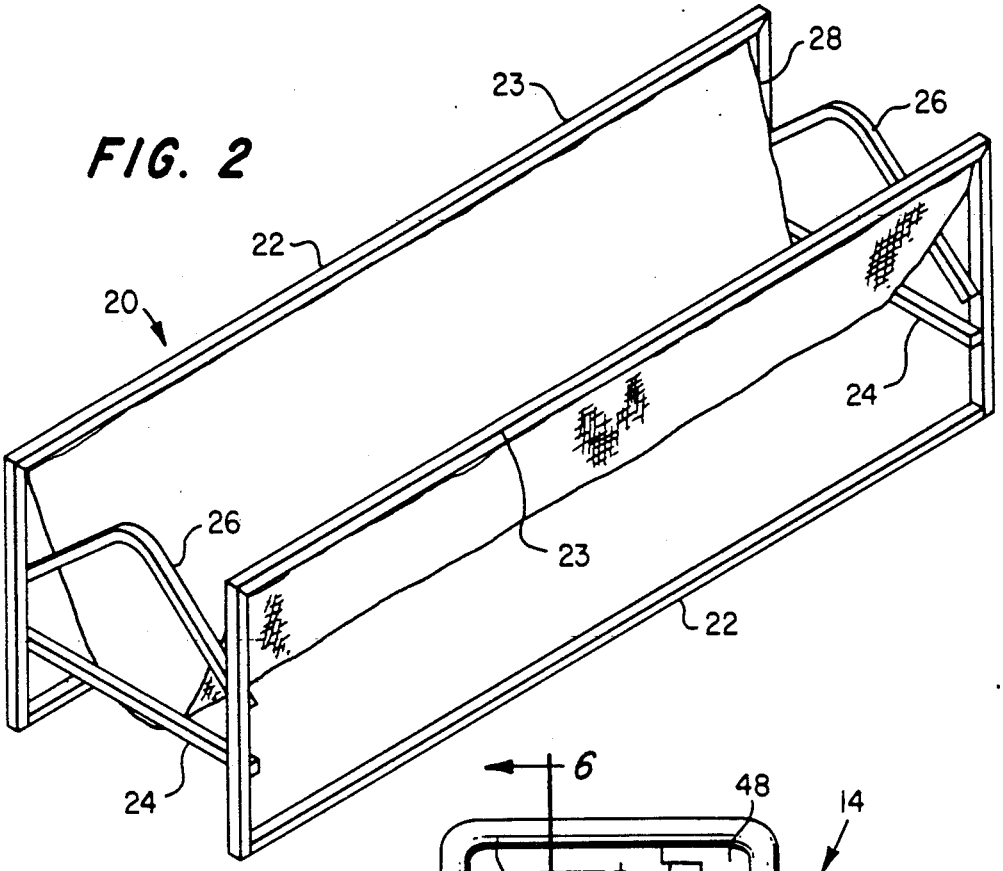
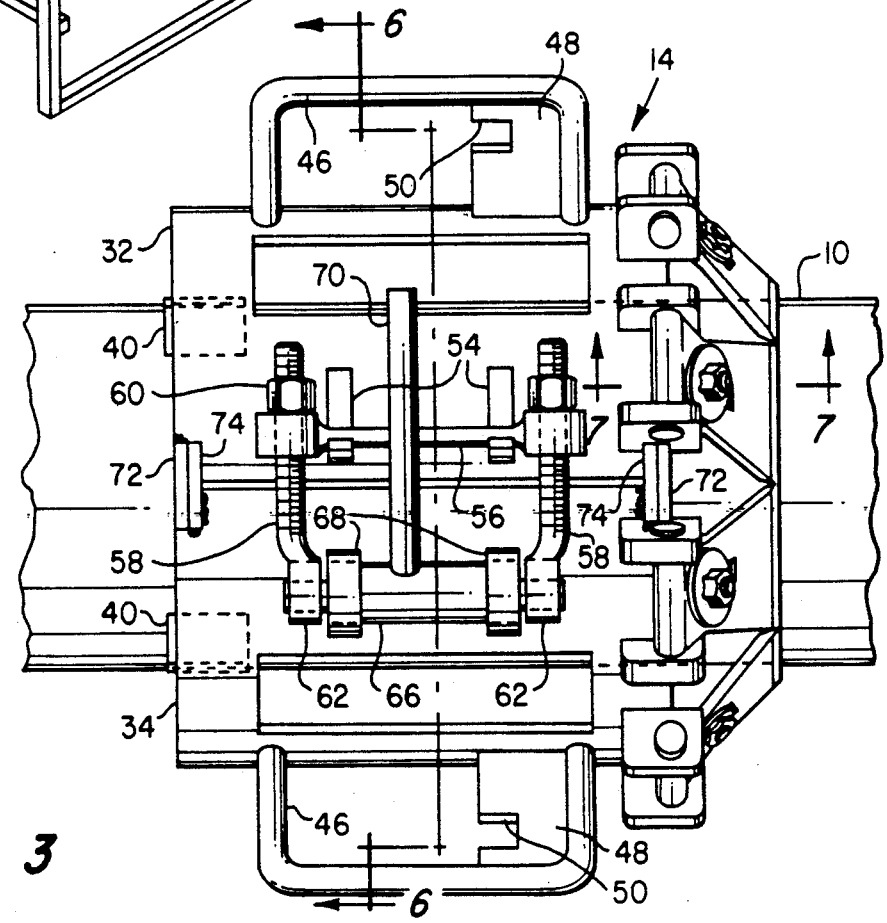
FIG. 3

PIPE COATING REMOVAL SYSTEM

BACKGROUND OF THE INVENTION

1. Field of the Invention

The present invention pertains to a pipe coating removal tool and coating collection receptacle adapted for removing particularly hard, thick coatings from pipelines, which coatings may require extraordinary disposal methods.

2. Background

In reconditioning and rebuilding pipelines, it is often necessary to remove protective coatings therefrom. Many types of pipe coatings become relatively hard and difficult to remove other than by mechanical means but require removal during reconditioning and/or rebuilding of the line. Certain types of pipe coatings are known to include toxic materials such as asbestos which must be disposed of in a specific manner which does not permit merely dumping the removed coating into the pipe trench or on the ground surface adjacent to the pipe.

The above-noted requirements in the field of pipe coating removal have presented certain problems for pipe maintenance and construction operations, which problems are overcome in a preferred manner by the present invention.

SUMMARY OF THE INVENTION

The present invention pertains to a pipe coating removal tool and method wherein relatively hard and/or tightly-adhered pipe coatings may be continuously removed from underground and surface pipelines and the like.

In accordance with one important aspect of the present invention, a pipe coating removal tool is provided which may be mounted on and removed from a continuous length of pipeline and pulled along the pipe to scrape coating material from the pipe in a uniform and substantially circumferential manner. The pipe coating removal tool is provided with a unique arrangement of scraping blades which are arranged to provide circumferential removal of coating material.

In accordance with another aspect of the present invention, a pipe coating removal tool is provided which includes means for adjusting the position of a plurality of pipe scraping blades whereby the tool may be easily centered on the pipe and each of the scraper blades adjusted to perform a thorough scraping or coating removal action. In accordance with still a further aspect of the present invention, a pipe coating removal tool is provided which is formed of opposed generally semi-cylindrical body members which are hinged together and adapted to be easily and quickly opened and closed for easy mounting on and removal of the tool with respect to a continuous length of pipe. The coating removal tool is provided with a quick release mechanism for the opposed body members which permits rapid and relatively easy handling for mounting on and removal from the pipe.

In accordance with another aspect of the present invention, a pipe coating removal system is provided which includes an improved pipe coating removal tool and a catcher for collection and disposal of pipe coating materials which require extraordinary disposal means. The catcher is arranged to be supported on the pipe and moved therealong with the coating removal tool to catch and collect coating material as it is removed from the pipe.

Those skilled in the art will further appreciate the above-noted advantages and features of the present invention together with other superior aspects thereof upon reading the detailed description which follows in conjunction with the drawing.

BRIEF DESCRIPTION OF THE DRAWING

FIG. 2 is a perspective view of the coating material catcher frame;

FIG. 3 is a plan view of the tool illustrated in FIG. 1 shown disposed on a section of pipe in an operative position;

DESCRIPTION OF A PREFERRED EMBODIMENT

Figure 1:
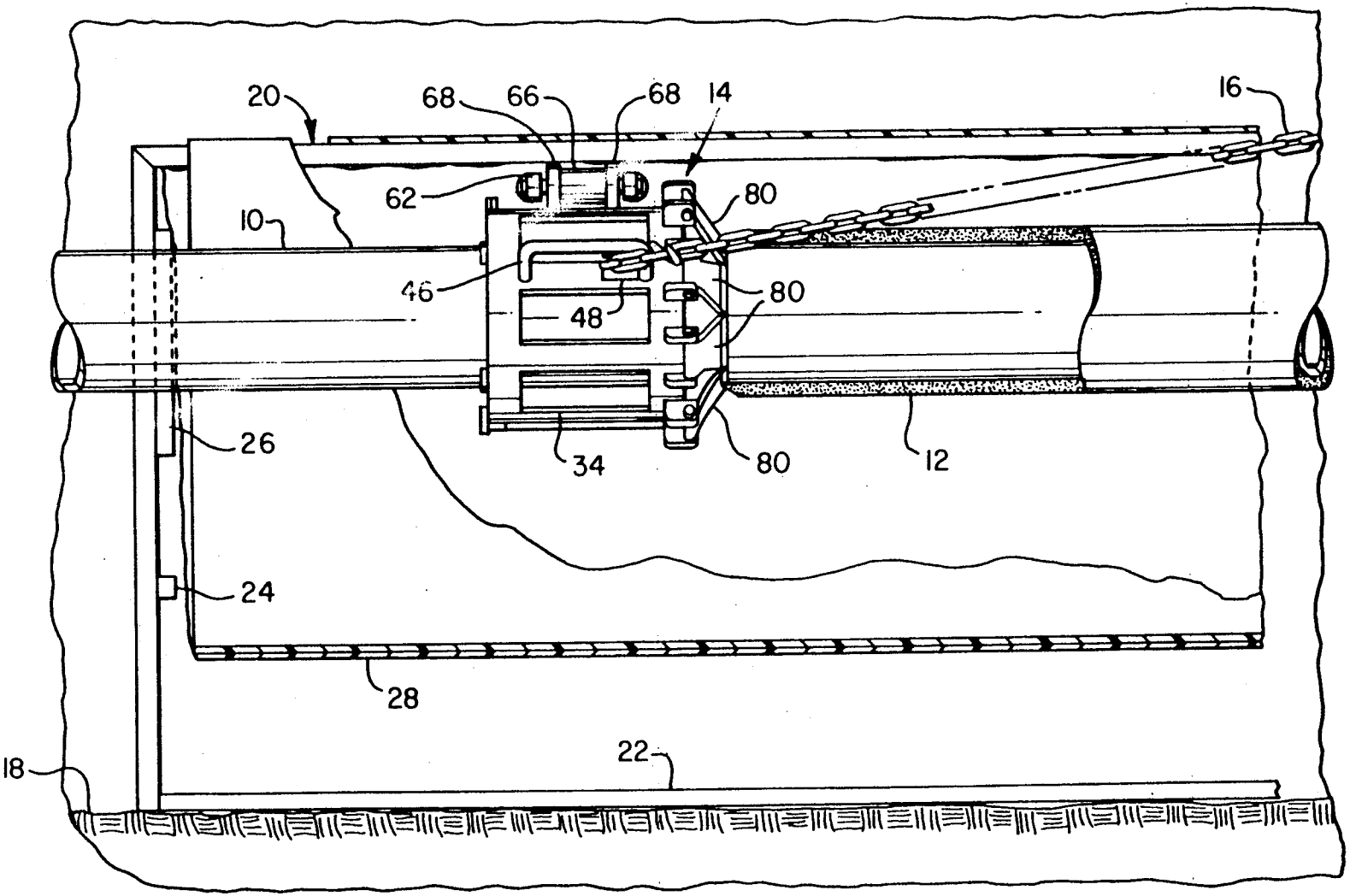
FIG. 1 is a side view of a pipe coating removal tool and catcher in accordance with the present invention in operation to remove pipe coating from an underground section of pipeline.

In the description which follows, like parts are marked throughout the specification and drawing with the same reference numerals, respectively. The drawing figures are not necessarily to scale.

Referring now to FIG. 1 there is illustrated a section of pipeline 10 having a compositional type coating 12 thereon which is being removed by a unique coating removal tool in accordance with the present invention and generally designated by the numeral 14. The tool 14 is adapted to encircle the pipeline section 12 and to be traversed therealong by pulling the tool with suitable means including a chain bridle arrangement, generally designated by the numeral 16. The illustration of Figure shows the pipe section 10 in an underground installation and around which an excavation 18 has been made to expose the pipe for reconditioning, including removal of the coating 12. Accordingly, the bridle 16 may be connected at an end, not shown, to suitable pulling means such as a tractor, also not shown, disposed on the earth's surface above the excavation 18.

Certain types of previously-used pipe coatings may include toxic materials such as asbestos. Accordingly, these materials may not be allowed to be deposited in the excavation 18 and are subject to extraordinary disposal means. In this regard, an improved coating catcher arrangement is provided which includes a frame, generally designated by the numeral 20, see FIG. 2 also. The frame 20 is characterized by opposed, generally parallel extending perimeter frame members 22 of generally rectangular configuration which are interconnected by opposed cross members 24 and opposed yoke members 26. The yoke members 26 are detachably connected to the perimeter frame members 22 at least at one end so that they may be swung over the pipe 10 in supporting relationship of the frame 20 on the pipe and to be traversed therealong as the tool 14 is pulled along the pipe to remove the coating 12. The catcher 20 includes a flexible hammock 28 whose opposed longitudinal sides are secured to the upper longitudinally extending portions 23 of the opposed frame members 22 as illustrated in FIG. 2. A removable sheet 25, FIG. 1, is preferably laid on the hammock 28 to receive coating material collected by the catcher 20 as the tool 14 traverses the pipe section 10. When a sufficient amount of material has collected on the aforementioned sheet to essentially "fill" the sheet, it may be removed from the hammock 28 and suitably disposed in a sealed container or otherwise transported to a suitable disposal site.

Figure 6:
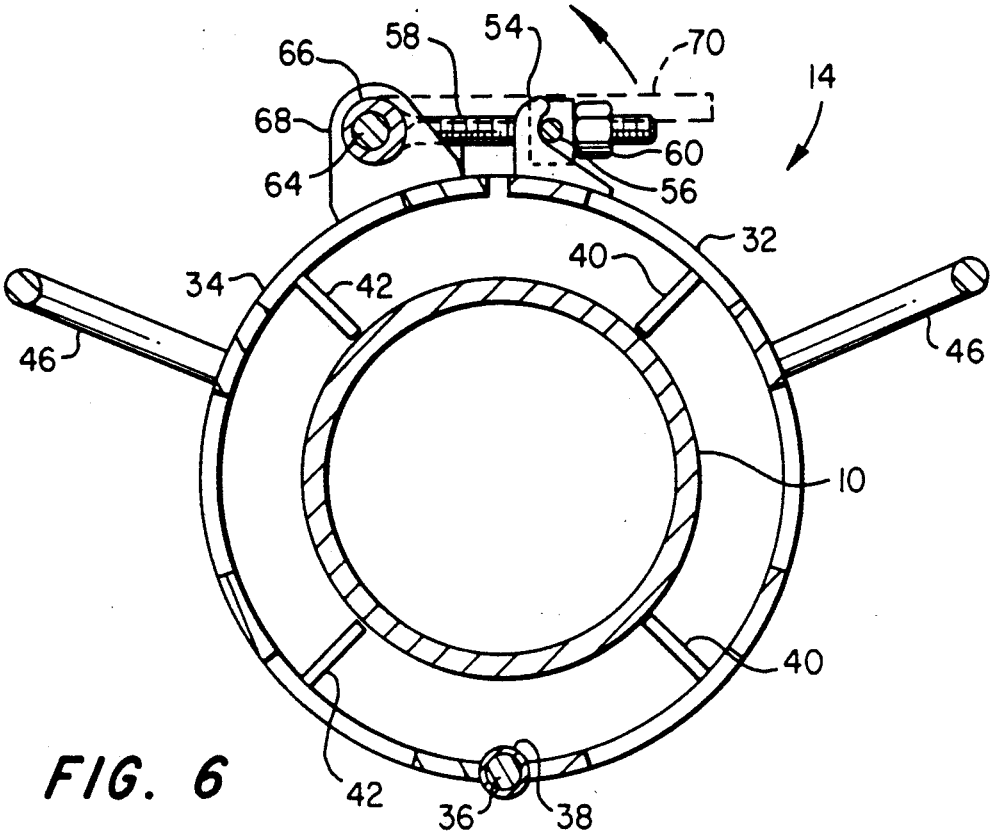
FIG. 6 is a section view taken generally along the line 6—6 of FIG. 3.

Referring now to FIGS. 3 and 6, in particular, the tool 14 is characterized by a pair of opposed, generally semi-cylindrical body members 32 and 34 which are provided with suitable hinge means comprising one or more pins 36 suitably secured to one of the body members and a corresponding journal sleeve 38 suitably secured to the other of the body members. Each of the body members 32 and 34 is also provided with plural radially inwardly projecting support fins 40 and 42, respectively, which aid in supporting the tool 14 centered on the pipe section 10. Each of the body members 32 and 34 is also provided with a suitable U-shaped handle bar 46, each having a web portion 48 with a suitable notch 50 formed therein for connecting the bridle 16 to the tool as illustrated in FIG. 1.

The body members 32 and 34 are secured together in surrounding relationship to the pipe section 10 by a suitable locking mechanism which is characterized by a pair of spaced-apart hook members 54 on the body member 32 which engage a locking pin 56. The locking pin 56 has opposed end portions which are slidably disposed on threaded arms 58 which are each provided with an adjusting nut 60 for adjusting the position of the locking pin 56 with respect to the hook members 54 to adjust the clamping force exerted between the body members 32 and 34 in the closed and locked position of the tool illustrated in FIGS. 1, 3, 4 and 6. The arms 58 each include a base portion 62 pivotally disposed on opposed trunnions 64 which are supported on a handle-base member 66. The base member 66 is, in turn, rotatably disposed in and supported by spaced-apart lugs 68 secured to the body member 34, as shown. The base member 66 is also connected to a suitable handle 70. The axis of rotation of the pin 64 is eccentric with respect to bores in the lugs 68 which journal the base member 66. Accordingly, upon rotation of the handle 70 and the base member 66 in a clockwise direction, viewing FIG. 6, to the position shown in FIG. 6, the arms 58 and the pin 56 are moved laterally until the pin is in forcible engagement with the hook portions 54 to clamp the two body members in a closed position as illustrated. The body members 32 and 34 are also each fitted with respective pairs of cooperating guide members 72 and 74 which aid in aligning the body members 32 and 34 when they are brought to their closed and clamped position.

Figure 4:
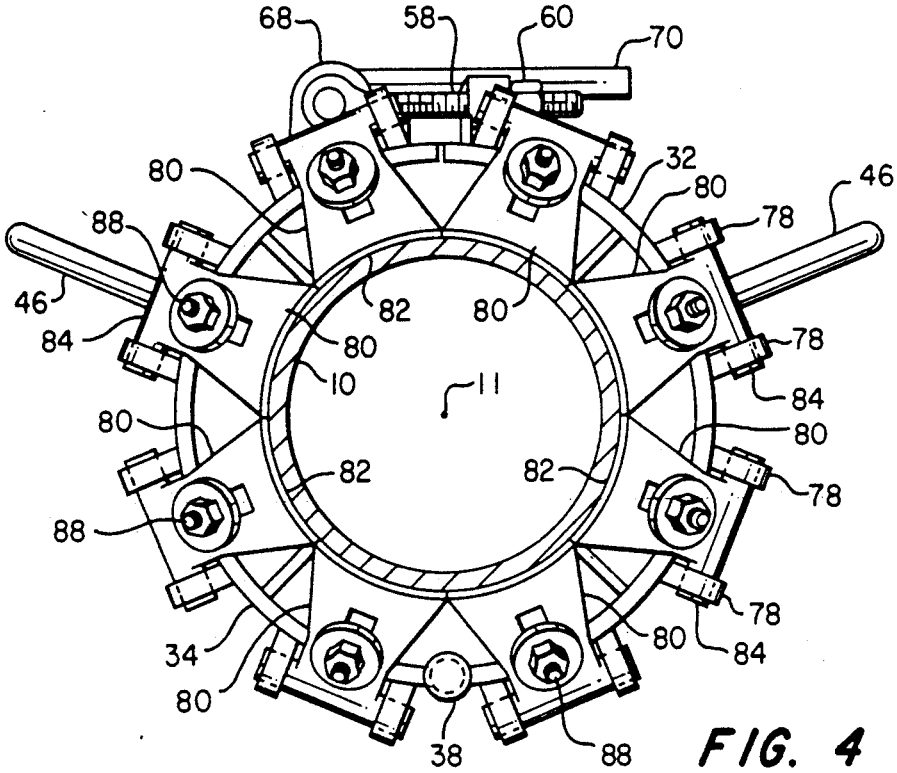
FIG. 4 is a transverse end view of the tool illustrated in FIG. 3 in the closed and locked position.
Figure 5:
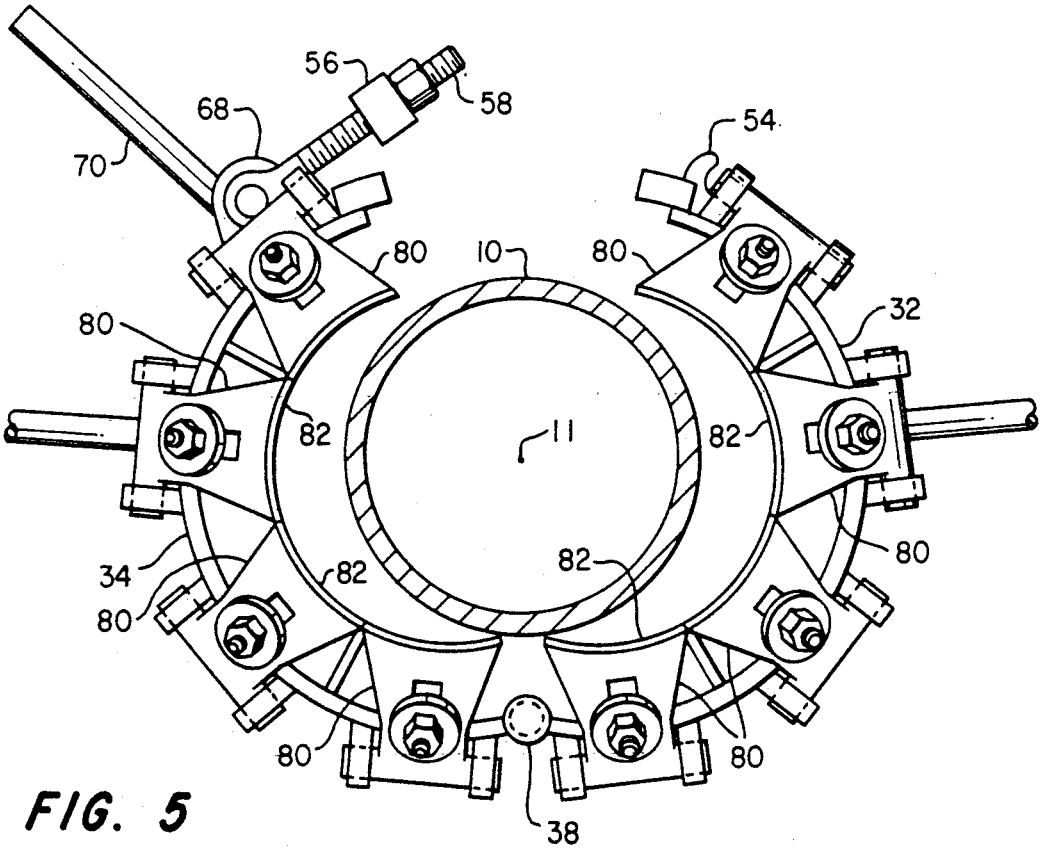
FIG. 5 is a view similar to Figure showing the tool in an unlocked and partially opened position.

Referring now to FIGS. 3 and 4, and also FIG. 5, the tool 14 is provided with a plurality of pairs of spaced-apart bosses 78 which are mounted on the respective body members 32 and 34 in a pattern such that a circumferential spacing of the bosses is provided in substantially equally spaced pairs, as illustrated. Each pair of bosses 78 supports a scraper blade 80 having a contoured cutting edge 82 formed thereon which substantially conforms to the radius of curvature of the outer diameter of the pipe section 10. The end of each scraper blade 80 opposite the end having the cutting edge 82 is provided with suitable means forming a pair of opposed trunnions 84 which are journaled in suitable bores formed in each of the bosses 78, as illustrated. Accordingly, the scraper blades 80 are each mounted for pivotal movement in a plane which passes through the central longitudinal axis 11 of the pipe section 10. In the preferred embodiment of the tool 14 illustrated in the drawing figures, a total of eight scraper blades 80 are mounted on the tool, four each on the respective body members 32 and 34. The cutting edges 82 of each blade 80 are adapted to be substantially contiguous with each other with respect to adjacent blades.

Figure 7:
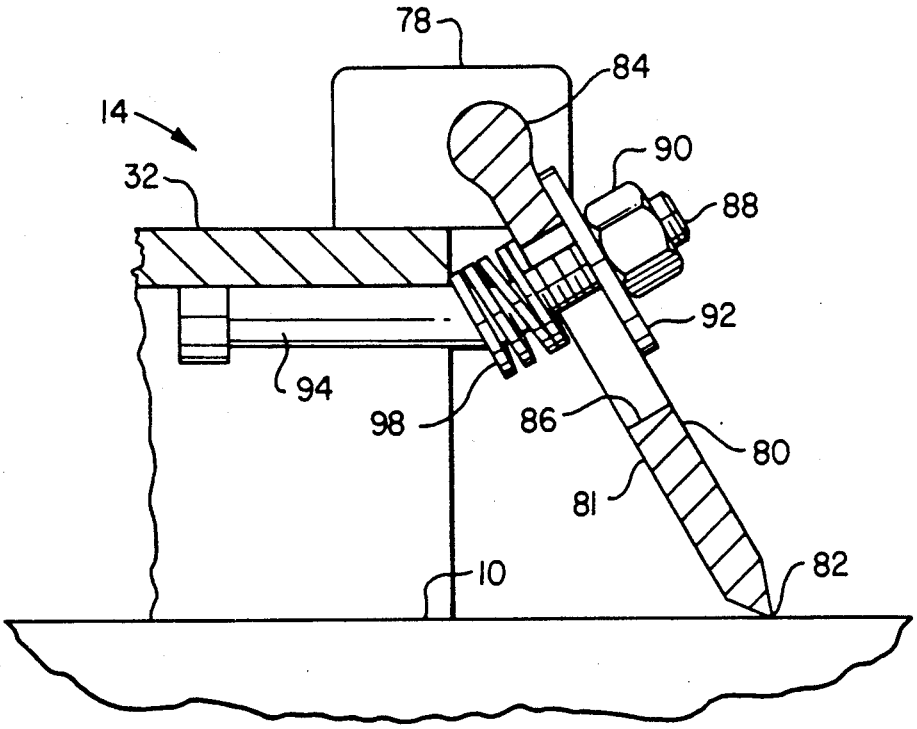
FIG. 7 is a detail section view taken along the line 7—7 of FIG. 3.

Referring now to FIG. 7, by way of example, the cutting blades 80 each have a body portion 81 in which an elongated slot 86 is formed and through which projects a threaded retainer member 88. The retainer member 88 is adapted to receive an adjusting nut 90 and a load-bearing washer 92 interposed between the nut and the body portion 81. The retaining member 88 includes a shank portion 94 which is suitably supported by the body member 32. Each cutting blade 80 is retained in a working position by a retaining member 88 whose shank portion 94 extends generally longitudinally with respect to the central longitudinal axis of the tool 14 when it is in a closed position and disposed over a pipe section 10 and which axis is coincident with the axis 11. The threaded portion of each retaining member 88 projects at an angle which typically would intersect the axis 11. A shock-absorbing coil spring 98 is preferably disposed over the retaining member 88 and retained between the blade body portion 81 and the shank 94 of the retaining member 88.

The operation of the tool 14 is believed to be readily understandable to those of ordinary skill in the art from the foregoing description. However, briefly, the tool 14 may be mounted on a section of pipe 10 which is exposed for removal of a coating therefrom by releasing the clamping mechanism comprising the pin 56 and the hooks 54 from engagement with each other so that the body members 32 and 34 may be swung about their cooperating hinge portions 36 and 38 to a position sufficiently open to assemble the tool around the pipe section. A small portion of the pipe section 10 typically would have its coating removed by manual methods over a length sufficient to provide assembly of the tool 14 onto the bare pipe. Upon assembly of the tool 14 to the pipe, the body members 32 and 34 are brought toward engagement of the clamp mechanism to its closed and locked position as illustrated in FIG. 4 whereupon, if required, the retaining nuts 90 are adjusted to cause the scraper blades 80 to have their cutting edges 82 brought just into engagement with the outer circumferential surface of the pipe section 10. Each of the scraper blades 80 would be adjusted so that a substantially uniform circumferential cutting or scraping action on the pipe would be provided. The springs 90 provide some shock-absorbing capability to minimize chatter of the cutting blades as the tool is pulled along the pipe section 10.

Once the tool is assembled to the pipe section 10, the catcher 20 is typically brought into position under the pipe preparatory to beginning the coating removal action and the bridle 16 is connected to the tool 14 and to suitable towing means, not shown. As the tool 14 is pulled along the pipe section 10, the scraper blades 80 rapidly scrape away old coating and debris which may be clinging to the pipe section 10 so that the pipe section may be prepared for recoating or other refurbishing procedures, as required. Typically, if a girth weld or flange connection is encountered by the scraping tool 14 as it is towed along a pipe, the clamping mechanism may be operated to quickly permit release of the body members 32 and 34 from the closed and locked position so that the blades 80 may be moved clear of the pipe section temporarily to permit passing over a girth weld or other obstruction whereby the tool is then reclosed over the pipe and the coating removal action resumed.

The tool 14 may be made of conventional engineering materials suitable for similar-type tools. Conventional low-carbon steel may be used for fabrication of the tool 14. The scraper blades 80 are preferably formed of heat-treatable and hardenable steel so that a relatively long-life cutting edge 82 may be obtained.

Although a preferred embodiment of the pipe coating removal tool, and the catcher system of the present invention has been described in detail herein, those skilled in the art will recognize that various substitutions and modifications may be made without departing from the scope and spirit of the invention as recited in the appended claims.

What is claimed is:

1. A tool for removing coatings from generally cylindrical pipe and the like comprising:

a pair of opposed body members hinged to each other for movement between open and closed positions;

a plurality of scraper blades mounted on respective ones of said body members, each of said scraper blades having a cutting edge engageable with the outer circumference of a section of pipe for effecting removal of a coating on said pipe in response to movement of said tool longitudinally along said pipe;

support means for said scraper blades;

retaining means for retaining each of said scraper blades in a position wherein said cutting edges are at least directly adjacent an outer surface of said pipe for effecting removal of said coating during movement of said tool relative to said pipe, said retaining means comprising cooperable threaded member and retaining nut means, said threaded member being supported on said body member for projection through slot means formed in said scraper blade whereby the position of said scraper blade relative to said body member and said pipe section may be adjusted by adjusting the position of said nut on said threaded member; and means for securing said body members in a closed and locked position so that said tool may be moved along said pipe to remove coating material therefrom.

2. The tool set forth in claim 1 wherein:

each of said scraper blades is supported on said one of said body members for pivotal movement in a plane generally parallel to and passing through the longitudinal central axis of said pipe section.

3. The tool set forth in claim 2 wherein:

each of said scraper blades includes opposed trunnion means and said body members are with means forming spaced-apart pairs of bosses for supporting each of said scraper blades for pivotal movement about said trunnion means.

4. The tool set forth in claim 2 including:

spring means disposed around said threaded members and engageable with said scraper blades for minimizing vibratory movement of said scraper blades as said tool is pulled along a section of pipe.

5. The tool set forth in claim 1 including:

alignment means supported on said body members for aligning said tool generally coaxial with the longitudinal axis of said pipe.

6. The tool set forth in claim 1 wherein:

one of said body members includes hook means formed thereon and the other of said body members includes locking means engageable with said hook means and supported for movement by an over-center eccentric locking mechanism whereby said body members may be brought into a closed position and clamped to each other by said locking means and for quick release of said locking means to permit hinged movement of said body members away from each other to allow for said scraper blades to clear obstructions on the outer circumference of said pipe.

7. The tool set forth in claim 1 including:

means on said tool for connecting said tool to a towing bridle for towing said tool along said pipe.

8. A tool for removing coatings from generally cylindrical pipe and the like comprising:

a pair of opposed body members hinged to each other for movement between open and closed positions;

means for securing said body members in a closed and locked position so that said tool may be moved along said pipe to remove coating material therefrom;

a plurality of scraper blades mounted on respective ones of said body members, each of said scraper blades having a cutting edge engageable with the outer surface of a section of pipe for effecting removal of a coating material on said pipe in response to movement of said tool longitudinally along said pipe;

support means for each of said scraper blades;

retaining means operably connected to said body members, respectively, and to each of said scraper blades for retaining each of said scraper blades in a position wherein the cutting edges of said scraper blades are at least directly adjacent said surface for effecting removal of said coating material, said retaining means including a member for retaining said cutting edge of said scraper blades directly adjacent said surface and to prevent the movement of said scraper blades away from said surface; and resilient means engageable with said cutting blade for biasing said cutting blade against said member to minimize vibration of said cutting blade during movement of said tool along said pipe.

9. The tool set forth in claim 8 wherein:

said resilient means comprises spring means and said retaining means includes a threaded member and a retaining nut engageable with said scraper blade to limit the movement of said scraper blade away from said surface.

* * * * *